US005935671A

United States Patent [19]

Lhuillier

[11] Patent Number: 5,935,671

[45] Date of Patent: Aug. 10, 1999

[54] SOLE-SHAPED SWEAT-ABSORBING DISPOSABLE HYGIENIC INSERT

[76] Inventor: Olivier Lhuillier, 7, rue Roger-Lhuillier, Arpajon, France

[21] Appl. No.: 08/849,210

[22] PCT Filed: Dec. 7, 1995

[86] PCT No.: PCT/FR95/01624

§ 371 Date: Aug. 26, 1997

§ 102(e) Date: Aug. 26, 1997

[87] PCT Pub. No.: WO96/17532

PCT Pub. Date: Jun. 13, 1996

[30] Foreign Application Priority Data

Dec. 8, 1994 [FR] France ..... 94 14757
Dec. 5, 1995 [FR] France ..... 95 14330

[51] Int. Cl.[6] ..... B32B 3/00

[52] U.S. Cl. ..... 428/57; 428/69; 428/161; 428/165; 428/192; 428/198; 428/225; 428/237; 428/310.5; 428/317.1; 604/367; 36/10; 36/43; 36/71

[58] Field of Search ..... 428/191, 225, 428/198, 237, 310.5, 317.1, 313.3, 69, 172, 161, 165, 57; 156/234, 230, 251, 268, 238; 36/43, 44, 10, 28, 30 A, 71; 604/366, 367

[56] References Cited

U.S. PATENT DOCUMENTS

| | | | |
|---|---|---|---|
| 2,121,604 | 6/1938 | Lynch et al. | 36/44 |
| 3,852,897 | 12/1974 | Bridge et al. | 36/44 |
| 4,151,660 | 5/1979 | Yoshimi et al. | 36/10 |

FOREIGN PATENT DOCUMENTS

| | | |
|---|---|---|
| 2 277 540 | 2/1976 | France . |
| 2 551 773 | 9/1983 | France . |
| 2 590 161 | 11/1985 | France . |
| 2 492 235 | 7/1987 | France . |
| 2 617 688 | 7/1987 | France . |
| 184 124 | 9/1936 | Germany . |
| 71 19 975 | 5/1971 | Germany . |
| 86 31 690 | 3/1987 | Germany . |
| 87 06 839 | 1/1988 | Germany . |
| 2 018 678 | 11/1979 | United Kingdom . |
| WO 86/01084 | 8/1984 | WIPO . |

*Primary Examiner*—Deborah Jones
*Assistant Examiner*—Abraham Bahta
*Attorney, Agent, or Firm*—Baker & Daniels

[57] ABSTRACT

A sweat-absorbing, disposable hygienic insert having a permeable inner film in contact with the foot, an outer film, and an absorbent layer intermediate the inner and outer films. The inner film is provided with a plurality of openings produced without removal of material. The absorbent layer has a flexible hygienic pad including absorbent material, hygienic additives and treatment additives. The outer and inner films are attached to one another at their edges, and are attached by at least one bond which passes through the hygienic pad, the bond located inside a boundary defined by the attached edges of the outer and inner films.

16 Claims, 2 Drawing Sheets

SOLE-SHAPED SWEAT-ABSORBING DISPOSABLE HYGIENIC INSERT

FIELD OF THE INVENTION

The present invention concerns a sole-shaped disposable hygienic insert with sweat-absorbing pad, of an article of footwear such as mules, half-mules or ballerinas or of an article of clothing such as ankle socks or socks of this type including a permeable film in contact with the foot, an absorbent layer and a film in contact with the shoe.

BACKGROUND OF THE INVENTION

Such an absorbent inner sole is already known from the document FR 87 09 708.

In addition, various makers offer inner linings or "inner soles" which are not well adapted to the problem of heating up of the feet as a result of excessive sweating, their aim being above all to obtain a warmer shoe, or height compensation between the shoe and the foot. These essentially flat inner soles made of natural products such as skins, leather, cork, textiles or synthetic products, are made of a single material or of combined materials.

The average life of these types of linings is equivalent to the life of the shoe for the most durable ones; comfort and hygiene are reduced even if some linings are washable. In addition, the materials used become either weak or more and more rigid, depending on their nature.

The principle drawbacks are as follows:

premature ageing through chemical burning of the materials constituting the shoe, rapid degradation of the qualities of comfort of the walking elements such as socks, stockings, or tights, due in particular to the accumulation of sweat, more or less restricting treatments dispensed on broken skin, blisters, and fungal infections, emanation of an offensive odour relating to sweat.

OBJECTIVES AND SUMMARY OF THE INVENTION

The object of the invention is to remedy these drawbacks, and to this end concerns an insert of the type defined above, characterized in that:

the outer sealing film is very fine, made of synthetic material, the hygienic pad of natural materials is highly flexible and lightly packed, hygienic additives and treatment additives are added to the flexible pad, the inner film, a few hundredths of a millimeter thick, is pierced, the films are glued or welded to one another at their edges.

The insert makes it possible to eliminate sweat as uniformly as possible by drainage associated with frequent replacement (disposable insert), which provides a particularly hygienic lining. The shape of this insert corresponds principally to the sole of the foot, but it may extend onto the sides and the top, in the mule and ballerina versions. In the very economical versions, the insert is flat, in the form of a strip with two rounded ends.

The mule and ballerina versions may also be provided with a textile or a film covering the rest of the foot, the ankle and the calf, in order to provide an ankle sock and a sock, but also a half-mule version constituted only by the front of a mule.

According to other advantageous characteristics:

the two films are glued or welded by point-like traverses made in the hygienic pad.

the inner film is pierced with "lanced" holes in the shape of micro-funnels, or cut by small slits, single or combined into stars, produced without removal of material.

the insert contains products which in the presence of sweat stiffen the insert, comprising pellets or reactive surfaces which gradually change colour, depending on the concentration of sweat.

the insert is extended onto the sides and the top of the foot, either by the pad or simply by one or both films, shaped and then glued or welded to one another completely or at various points, or by separate upper and vamp parts also joined by gluing or welding to the base insert, or it is provided with a textile or a film covering the rest of the foot, the ankle and the calf in order to provide an ankle sock and a sock.

the pad is based on sphagnum or loofah.

point-like aeration passages are provided in the sides and on the top of the foot.

pre-glued adhesive areas, protected by paper before being installed, are situated on the outer film in order to be applied, without spoiling, to the insole and/or to the sides of the shoe, or situated on the inner film of a mule or a ballerina, in the direction of the top and of certain lateral areas of the bare or sock-covered foot.

the insert includes a thin film, covering the inner film, for the continuous manufacture of an assembly formed of the outer sealing film, the hygienic pad, the inner film, itself optionally provided with another film, to form a sheet which is cut out to the shape of the insert to be manufactured, the cut-out portions being welded at the same time in order to provide the disposable insert.

BRIEF DESCRIPTION OF THE DRAWINGS

The present invention will be described in more detail hereinafter by means of the accompanying drawings, in which.

DESCRIPTION OF A PREFERRED EMBODIMENT

Figure 1:
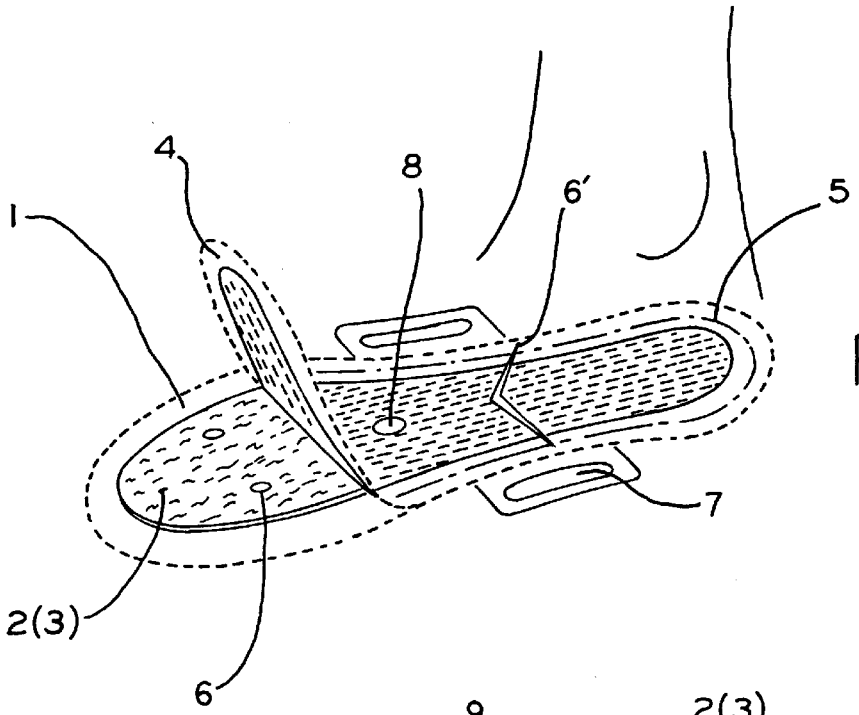
FIG. 1 shows diagrammatically in perspective an embodiment of a sole-shaped absorbent insert according to the invention.

According to FIG. 1, the invention, applied to the production of an inner sole, consists of a hygienic insert with a sweat-absorbing pad, composed of a very fine sealing outer film 1 (that is to say, arranged underneath) made of synthetic material. This film is provided with a hygienic pad 2 of absorbent natural material which is highly flexible and lightly packed, containing hygienic additives and treatment additives indicated diagrammatically by the reference 3.

The pad 2 is covered with an inner film 4 a few hundredths of a millimeter thick. This film is pierced to allow sweat to pass through. This is the face which will be next to the foot. In FIG. 1 the inner film 4 (that is to say, next to the foot) is lifted up at the front to show the pad 2.

According to the invention, the films 1 and 4 are glued or welded to one another at their edge. They may also be joined by point-like bonds 6 passing through the pad 2.

The inner film 4 is provided with lanced holes in the shape of micro-funnels; it may also be cut by small slits, single or combined into stars; these holes generally being produced without removal of material.

Thus, according to FIG. 1, the hygienic insert consists of a structure with four components.

In more detail:

The sealing film 1 is very fine; it is smooth or cellular and preferably its surface is not slippery. This film is applied directly to the mounting insole of the shoe in the case of an article of footwear, or inside a sock in the case of an article of clothing. Its function is to avoid the passage of sweat. This very light film is made principally of synthetic material; its thickness is between a few hundredths and a few tenths of a millimeter. In certain applications it may be stiffened by a heat treatment, for example on the edge portions so as to form a border, or the underside of the foot at the front of the insert; however, in spite of this shaping, it should remain flexible in order to allow it to be packed folded or rolled for distribution.

The function of the highly flexible hygienic pad 2, placed on the sealing film, is to absorb sweat. This very light pad is made of a natural material such as cellulose, cotton wool, sphagnum, or loofah; it may also be of viscose or materials used singly or combined by mixing, carding, combing, pressing, weaving, gluing, flocking, napping, stitching, or calendering so as to form a pad approximately 1 to 2 mm thick, the shape of which corresponds to that of the insert, but slightly reduced. This pad may also be in the shape of a simple strip. If need be, the pad is glued onto a film serving for manufacture and for installation, as will be seen subsequently.

The pad 2 contains the hygienic additives and treatment additives 3 to reduce sweating, combat skin complaints and give out a deodorant. These additives are added to the pad by impregnation or spraying before drying or in the form of powder. The additives may be combined with products which react slowly with sweat and gradually stiffen the pad as they absorb the sweat, in order to constitute an indication of wear; the insert should be changed when it reaches certain degrees of stiffness.

The film 4 may be a film of woven or non-woven cellulose fibres of a few tenths of a millimeter. The material may also be a mixed material, a mixture of natural materials and synthetic materials such as polyester fibres. The film or layer is in contact with the sole of the bare or sock-covered foot.

The edge 5 of the assembly thus formed is provided with a weld or gluing along a line or a strip. There are also weld points 6, constituting point-like bonds, or weld lines 6', for example in a V-shape, at the location of the arch of the foot, so as to immobilise the pad.

This assembly is provided with two pre-glued lateral wings or with an attachment means 7 in order to be immobilised inside the shoe. Finally, according to FIG. 1, a pellet 8 reacting to sweat is provided in order to constitute a detector.

The example shown in FIG. 1 corresponds to the simplest form of the hygienic insert according to the invention, that is to say an inner sole to be placed inside an article of footwear.

Figure 2:
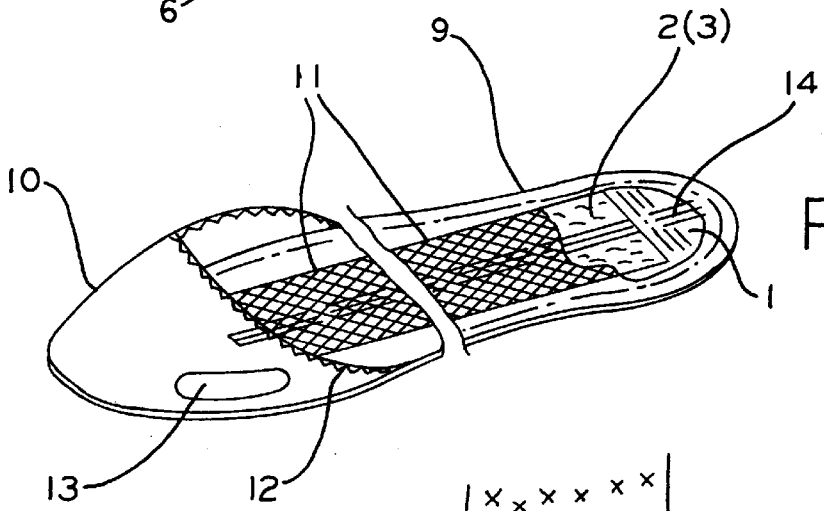
FIG. 2 shows a mule-like absorbent insert.

FIG. 2 corresponds to an exemplary embodiment of the invention forming a mule 9 or a half-mule 10 if it is just the front part. The hygienic insert integrated with this mule or half-mule is the same as that described above. The insert is additionally covered by a very thin film, perforated, slit, or woven in a very tight mesh 11; in this case the hygienic pad 2 is in the form of a rectangular piece corresponding to a strip. An elastic edging cord 12 is provided and lateral adhesives 13, as well as adhesive inner sole elements 14. The adhesive elements 14 are for example arranged on a longitudinal and transverse line.

Figure 3:
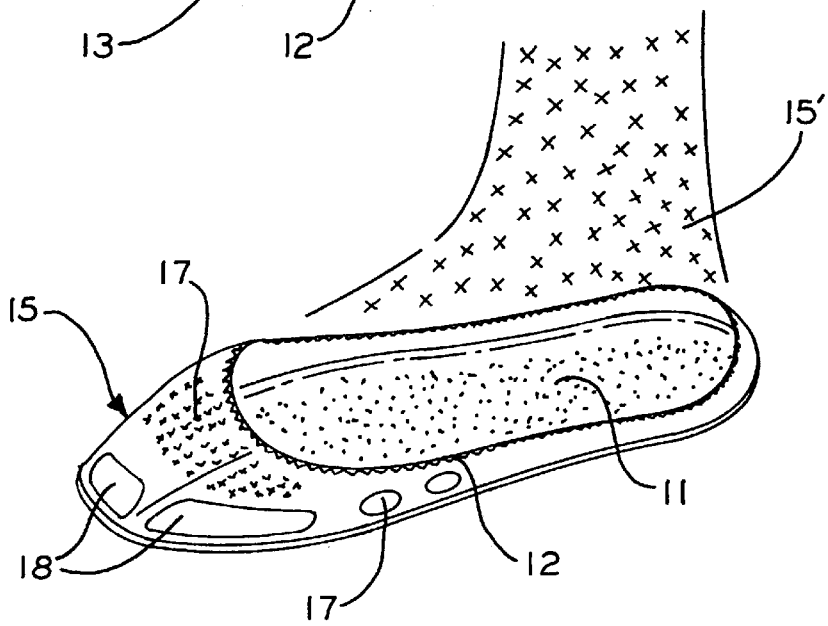
FIG. 3 shows a ballerina-like absorbent insert.

FIG. 3 shows an alternative form of hygienic insert in the shape of a ballerina 15. The insert is covered by a film 11 pierced with lanced holes with an elastic edging cord 12 and a textile sheet 15' covering the rest of the foot if the ballerina is combined with a sock. The sides are provided with aeration passages 17 and with padded areas 18 identical to the base hygienic insert.

FIGS. 4A, 4B, 5A and 5B are sectional views showing more precisely the structure of two assemblies serving for the production of the hygienic insert according to the invention.

Figure 4A:
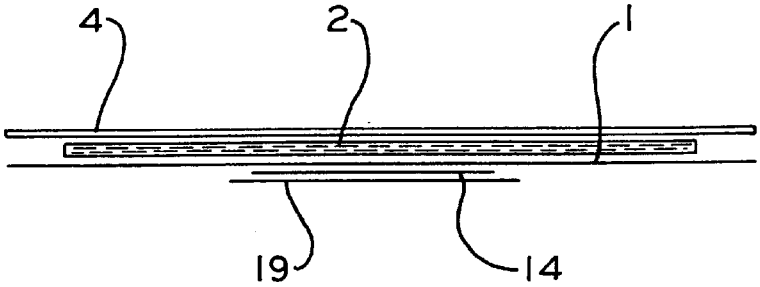
FIG. 4A shows a section through an alternative embodiment of a sub-assembly constituting an insert according to the invention.
Figure 4B:
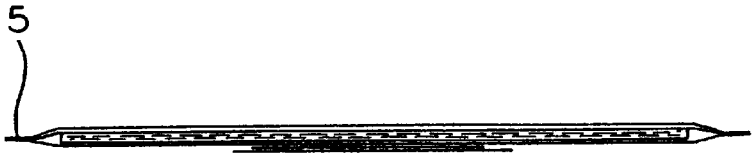
FIG. 4B shows the sub-assembly in FIG. 4A, welded.

According to FIGS. 4A and 4B, a sub-assembly is formed of the impermeable film 1, the hygienic pad 2 and the layer based on cellulose fibres 4. The film 1 has on its lower face a sticking surface 19 connected to the film by the bonding or sticking line 14.

FIG. 4B shows the assembly according to FIG. 4A, welded or glued along the edge 5.

Figure 5A:
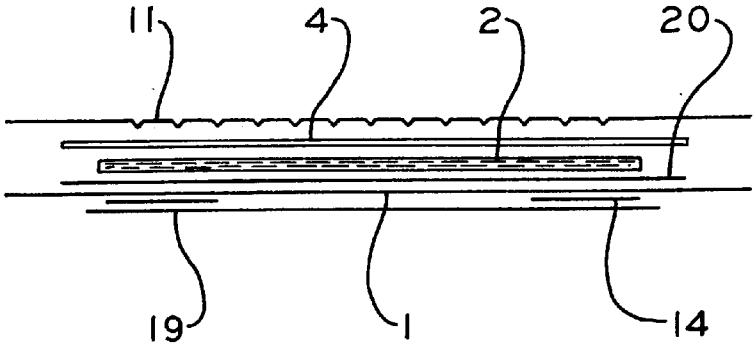
FIG. 5A shows a section through another embodiment of a sub-assembly constituting an insert according to the invention.
Figure 5B:
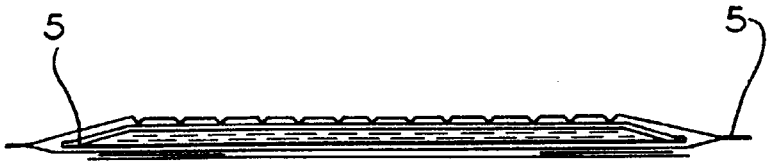
FIG. 5B is a view of a sub-assembly according to FIG. 5A, welded.

The alternative assembly shown in FIGS. 5A and 5B corresponds to a five-layer structure comprising the impermeable film 1, the absorbent pad 2 and the fibre-based film 4, then a film 11 covering the film 4 and a very fine sealing film 20 serving for manufacture.

This film 20 is necessary during the preliminary manufacturing operations; it serves as a support by gluing onto the hygienic pad 2 with or without the interposition of the layer of cellulose fibres 4.

In fact, for the production of the hygienic insert according to the invention, a continuous process may be used in order to produce the assembly, the structure of which is shown in section in FIG. 5A. Depending on the nature of the material of which it consists, the hygienic pad 2 is more or less fragile and is not self-supporting.

Inasfar as the insert is obtained by cutting out, a multilayer assembly like that in FIG. 5A is produced continuously. The product may be rolled up for transportation between the factory manufacturing this assembly and the cutting and welding factory which produces the actual insert.

For these different operations, it is indispensable to hold certain absorbent materials, not self-supporting, by both faces, hence the need for the film 20, which is preferably very fine.

FIG. 5B shows the product provided with welds 5.

As already indicated above, the upper or inner film 4 has perforations in the form of holes which are lanced without removal of material. As a result, these perforations have a micro-funnel shape, the wider opening of which is situated next to the sole of the foot; sweat passes easily through the film during walking; it is retained by capillary action, first in the film, then in the hygienic pad. Moreover, the pumping effect exerted on the insert during walking facilitates this transfer movement.

It has also been indicated that the hygienic pad 2 is placed between the lower or outer film 1 and the upper or inner film 4 or between, on the one hand, the lower film 1 and, on the other hand, the films 4 and 11 in that order. These assemblies may be glued or welded at the edge, but they may also have there a light holding gluing between the different layers in order to avoid internal slipping, or the formation of clumps, bumps or local over-thicknesses.

In the case of the pad 2 and the cellulose-based film 4, micro-gluing which allows the transfer of sweat may be provided.

The point-like fixing traverses produced in the hygienic pad allow complementary gluing or welding between the sealing film 1 and the cellulose-based film 4, or the sealing film and the pierced, slit, or woven film 11 and the film 4, in order to obtain an absorbent assembly offering greater homogeneity. These transverse bonds may be almost point-like such as those indicated by the reference 6, or linear as indicated by the reference 6'; in this case the impression may even represent a logo, a trademark or more generally a distinctive symbol making it possible to identify the product. According to other advantageous characteristics of the invention, the pad, or even the insert in general, may include pellets or reactive surfaces such as the pellet 8, which gradually react to the concentration of sweat, for example by changing colour.

The pre-glued adhesive areas such as the areas 14 are protected before the installation of the insert by siliconized paper, overlapping from these areas onto the sealing film 1, so as to be applied to the mounting insole and/or to the sides of the shoe by the wings 7 in order to complete the holding of the insert, without spoiling the inside of the shoe, that is to say, being able to be removed easily without leaving any trace.

It is also possible to provide mechanical attachment means, beneath the sole of the foot or on the wings for rapid installation of the absorbent insert.

In the case of application to articles of footwear, the sides and the top of the foot may have point-like aeration passages such as the passages 17.

Finally, the opening, in the case of application to articles of footwear such as mules or ballerinas, may be edged by an elastic cord.

What is claimed is:

1. A sweat-absorbing, disposable hygienic insert comprising a permeable inner film in contact with the foot, an outer film, and an absorbent layer intermediate said inner and outer films; wherein said inner film is provided with a plurality of openings, said openings produced without removal of material; said absorbent layer comprises a flexible hygienic pad comprising absorbent material, hygienic additives and treatment additives; said outer and inner films are attached to one another at their edges; and said outer and inner films are attached by at least one bond which passes through said pad, said bond located inside a boundary defined by the attached edges of said outer and inner films.

2. The disposable hygienic insert of claim 1, further comprising means for extending said insert onto the sides and the top of the foot.

3. The disposable hygienic insert of claim 1, wherein said absorbent material is selected from the group consisting of cellulose, cotton wool, viscose, sphagnum and loofah.

4. The disposable hygienic insert of claim 1, wherein said insert is provided with aeration passages in a portion of said insert which is disposed adjacent one of the side and top of the foot.

5. The disposable hygienic insert of claim 1, further comprising pre-glued adhesive areas situated on said outer film, whereby said insert may be adhered to the insole and/or the sides of a shoe, or to the inner film of a mule or a ballerina.

6. The disposable hygienic insert of claim 1, further comprising a thin film intermediate said outer and inner films, said intermediate film adjacent said absorbent layer.

7. The disposable hygienic insert of claim 1, wherein said insert is sole-shaped.

8. The disposable hygienic insert of claim 1, wherein said edges of said inner and outer films are glued to one another.

9. The disposable hygienic insert of claim 1, wherein said edges of said inner and outer films are welded to one another.

10. The disposable hygienic insert of claim 1, wherein said openings are lanced holes in the shape of micro-funnels.

11. The disposable hygienic insert of claim 1, wherein said openings are slits.

12. The disposable hygienic insert of claim 11, wherein said slits are combined into stars.

13. The disposable hygienic insert of claim 1, further comprising one of a pellet and a reactive surface, which gradually changes colour responsive to the concentration of sweat in said insert.

14. The disposable hygienic insert of claim 5, further comprising means for protecting said pre-glued adhesive areas.

15. The disposable hygienic insert of claim 1, wherein said outer film is made of synthetic material.

16. The disposable hygienic insert of claim 1, wherein said at least one bond attaches said outer and inner films directly to one another.

* * * * *